United States Patent [19]

Ziemer

[11] 4,410,343

[45] Oct. 18, 1983

[54] AIR BOILING PROCESS TO PRODUCE LOW PURITY OXYGEN

[75] Inventor: John H. Ziemer, Grand Island, N.Y.

[73] Assignee: Union Carbide Corporation, Danbury, Conn.

[21] Appl. No.: 334,238

[22] Filed: Dec. 24, 1981

[51] Int. Cl.[3] ..... F25J 3/02

[52] U.S. Cl. ..... 62/29; 62/31; 62/34; 62/43

[58] Field of Search ..... 62/38, 31, 34, 43, 9, 62/11, 12, 13, 17, 18, 19, 23, 24, 32, 42, 44, 29

[56] References Cited

U.S. PATENT DOCUMENTS

| | | | |
|---|---|---|---|
| 2,209,748 | 7/1940 | Schlitt | 62/175.5 |
| 2,664,719 | 1/1954 | Rice et al. | 62/122 |
| 2,779,174 | 1/1957 | Vesque | 62/38 |
| 2,812,645 | 11/1957 | Locklair et al. | 62/123 |
| 2,850,880 | 9/1958 | Jakob | 62/29 |
| 3,327,489 | 6/1967 | Gaumer | 62/29 |
| 4,208,199 | 6/1980 | Nakazato et al. | 62/29 |
| 4,254,629 | 3/1981 | Olszewski | 62/13 |

*Primary Examiner*—Frank Sever
*Attorney, Agent, or Firm*—Stanley Ktorides

[57] ABSTRACT

Low purity oxygen is produced by a process which employs a low pressure column and a medium pressure column, wherein the bottoms of the low pressure column are reboiled against condensing air and the resulting condensed air is fed into both the medium pressure and the low pressure column.

10 Claims, 1 Drawing Figure

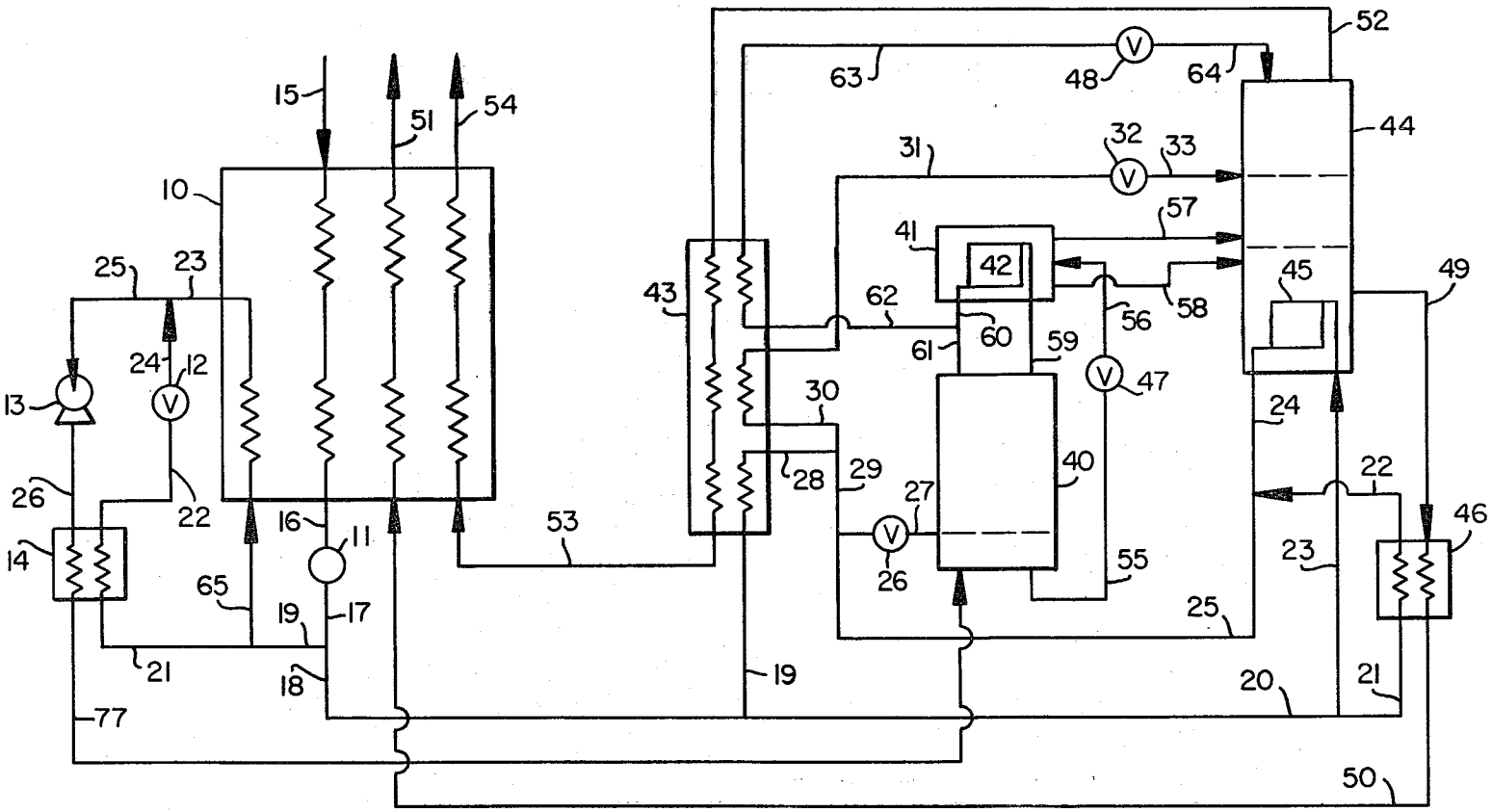
10
11
12
13
14
15
16
17
18
19
20
21
22
23
24
25
26
27
28
29
30
31
32
33
40
41
42
43
44
45
46
47
48
49
50
51
52
53
54
55
56
57
58
59
60
61
62
63
64
65
77

AIR BOILING PROCESS TO PRODUCE LOW PURITY OXYGEN

TECHNICAL FIELD

This invention relates generally to the field of cryogenic air separation by rectification and more specifically to the field of cryogenic air separation by rectification wherein compressed air is employed to reboil low pressure column bottoms to produce vapor reflux.

BACKGROUND ART

As the energy requirements of society continue to increase and as the ability of oil to meet these requirements becomes more questionable, there has been increased incentive to develop alternate sources to supply major portions of the world's energy requirements. One such alternate source is coal which is found in abundance in many areas of the world. However, coal has certain problems associated with its use which contributed to its original decline as an energy source and to its relatively unenthusiastic acceptance as a current alternate energy source. Among these problems are the cost of transporting coal over long distances and the relatively high levels of pollutants generated when coal is burned. Both of these drawbacks are ameliorated when coal is converted to a liquid or gaseous hydrocarbon fuel. Therefore, there has been an extensive effort to expand known and to develop and commercialize new coal gasification and liquefaction techniques.

Many coal gasification and liquefaction processes require oxygen to partially oxidize the coal and thereby supply energy for the conversion process. Oxygen is preferred over air to avoid introducing large amounts of nitrogen into the conversion process and to reduce the amount of oxidant which must be compressed. Generally, the oxygen required for these coal conversion techniques is in the purity range of from about 90 to 99 percent, and more preferably, from 95 to 98 percent. Oxygen in this general purity range is often referred to as low purity oxygen. Low purity oxygen is adequate because the oxygen is used for combustion with coal which itself contains impurities.

The production of oxygen by processes employing the fractionation of air has long been known. However, most of these processes are designed to produce high purity oxygen, i.e., oxygen of at least 99.5 percent purity. As indicated above, oxygen of such high purity is not required for many coal conversion techniques. Therefore, methods which produce oxygen of low purity are becoming increasingly important.

Most methods of producing high purity oxygen by air separation employ a double column arrangement wherein a high pressure column and a low pressure column are in heat exchange relation. The high pressures required to produce high purity oxygen are not required for the production of low purity oxygen and thus many of the known low purity oxygen production methods employ just the low pressure column with an associated or side column at a medium pressure.

In a typical high purity oxygen production process employing a low pressure and high pressure column, the vapor from the top of the high pressure column is used to reboil the bottoms of the low pressure column in order to supply vapor reflux to the low pressure column. Although there do exist low purity oxygen production processes which employ the vapor from the top of the medium pressure column to effect this reboil, it is generally preferable to employ compressed feed air to reboil the low pressure column bottoms because of the relatively higher operating pressures of the medium pressure column required by the former methods.

Methods which employ feed air to reboil the low pressure column bottoms are generally termed "air boiling" methods and several such methods for producing low purity oxygen are known in the art.

One such method is described in U.S. Pat. No. 2,850,880—Jakob wherein air is supplied at a single head pressure to both the low pressure column main condenser and the medium pressure ccolumn as a feed. Another such method is described in U.S. Pat. No. 4,208,199—Nakazato et al. wherein air is supplied at a single head pressure to both the low pressure column main condenser and to the medium pressure column as feed. The liquid air which is condensed to effect the reboil is fed to the medium pressure column as additional feed.

Both of these prior art processes suffer from the requirement of supplying air to the medium pressure column at the same pressure required by the main condenser. The pressure of the air to the main condenser must be relatively high in order to achieve good reboil of the low pressure bottoms. Thus, these single head pressure methods are disadvantageous from the standpoint of energy efficiency.

Another prior art process is described in U.S. Pat. No. 2,209,748—Schlitt. This process uses air feed to the medium pressure column at a lower pressure than that employed in the main condenser. However, this method requires a two-step air condensation and as such requires a very high pressure in the main condenser; in effect, it approximates a high pressure column separation and is therefore also inefficient from an energy use standpoint.

A method to produce low purity oxygen by rectification of air in a medium pressure column and a low pressure column wherein feed air is employed to reboil the low pressure column bottoms which is more efficient than heretofore known such methods would be highly desirable.

It is therefore an object of this invention to provide an energy efficient process to produce low purity oxygen by fractionation of air employing a medium pressure column and a low pressure column.

It is another object of this invention to provide an energy efficient process to produce low purity oxygen by fractionation of air employing a medium pressure column and a low pressure column wherein feed air is employed to reboil the bottoms of the low pressure column.

DISCLOSURE OF THE INVENTION

The above and other objects which will become apparent to those skilled in the art are attained:

In a process for the production of oxygen by the fractionation of air, wherein feed air at greater than atmospheric pressure and substantially free of water and carbon dioxide is introduced (a) into a medium pressure column where it is separated by rectification into a nitrogen-rich fraction and an oxygen-enriched fraction, and (b) into a low pressure column where it is separated by rectification into a nitrogen-rich fraction and a product oxygen fraction; and wherein the low pressure column bottoms are reboiled in a main condenser to produce vapor reflux by indirect heat transfer with a higher pressure condensing feed air stream, the improvement comprising:

(1) introducing from about 50 to 75 percent of the gaseous feed air into the main condenser as said condensing feed air stream;

(2) introducing from about 25 to 50 percent of the gaseous feed air into the medium pressure column at a pressure lower than the pressure of said condensing feed air stream;

(3) expanding the condensed feed air stream to a lower pressure;

(4) introducing from about 50 to 75 percent of the condensed feed air stream into the medium pressure column as additional feed; and (5) introducing from about 25 to 50 percent of the condensed feed air stream into the low pressure column as feed.

BRIEF DESCRIPTION OF THE DRAWINGS

FIG. 1 is a schematic representation of a preferred embodiment of the process of this invention.

The term, column, is used to mean a distillation or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For an expanded discussion of distillation columns see the Chemical Engineers' Handbook, Fifth Edition, edited by R. H. Perry and C. H. Chilton, McGraw-Hill Book Company, New York Section 13, "Distillation" B. D. Smith et al, page 13-3, *The Continuous Distillation Process.* The term, double column, is used to mean a higher pressure column having its upper end in heat exchange relation with the lower end of a lower pressure column. An expanded discussion of double columns appears in *Ruheman* "The Separation of Gases" Oxford University Press, 1949, chapter VII, Commercial Air Separation.

DETAILED DESCRIPTION

This invention comprises a process which efficiently produces low purity oxygen by the fractionation of air wherein air is preseparated in a medium pressure column and finally separated in a low pressure column, wherein air is employed to reboil the bottoms of the low pressure column, wherein the pressure of the feed air to the medium pressure column is lower than air employed for the reboil, and wherein the air employed for reboil, after being condensed by heat tranfer with the bottoms, is introduced to both the medium pressure column and the low pressure column as feed The product of the process of this invention is low purity oxygen. Generally, the low purity oxygen product has a purity of from about 90 to 99 mole percent, preferably from about 95 to 98 mole percent.

The low pressure column of the process of this invention operates in the pressure range of from about 15 to 25 psia, preferably from about 18 to 22 psia and most preferably, at about 20 psia.

The medium pressure column of the process of this invention operates in the pressure range of from about 30 to 60 psia, preferably from about 40 to 50 psia, most preferably at about 45 psia.

The main condenser of the low pressure column wherein feed air is condensed against low pressure column bottoms to produce vapor reflux operates in the pressure range of about 50 to 80 psia, preferably from about 60 to 70 psia, most preferably at about 65 psia.

The incoming feed air is divided into two portions. One portion, comprising from about 25 to 50 percent of the feed air, preferably from about 35 to 50 percent, most preferably about 41 percent, is introduced into the medium pressure column as feed. Another portion of the feed air comprising from about 50 to 75 percent, preferable from about 50 to 60 percent, most preferably about 56 percent is introduced into the main condenser wherein it condenses to heat the column bottoms and to produce vapor reflux for the low pressure column.

The condensed feed air from the main condenser is fed into both the medium pressure column and the low pressure column. The portion of the condensed feed air stream fed into the medium pressure column comprises from about 50 to 75 percent of the stream, preferably from about 60 to 70 percent, most preferably about 63 percent. The portion of the condensed feed air stream fed into the low pressure column comprises from about 25 to 50 percent of the stream, preferably from about 30 to 40 percent, most preferably about 37 percent.

By introducing the feed air into the medium pressure column at a pressure lower than that of the feed air introduced into the main condenser one achieves efficiencies by allowing the medium pressure column to operate at its lowest effective pressure and at a pressure below that of the main condenser wherein higher pressures are required to effectively conduct the required heat transfer.

By dividing the feed air between the medium pressure column and the main condenser as defined by the process of the invention, one achieves the proper reflux ratios for the low pressure column while ensuring enough air feed for the medium pressure column to generate high quality liquid nitrogen reflux.

By dividing the condensed feed air stream from the main condenser between the medium pressure column and low pressure column as defined by the process of this invention, one achieves the proper reflux ratios for the medium pressure column.

By employing the defined dual gaseous feed air pressures and the defined gaseous feed air and condensed feed air stream divisions one can efficiently produce low purity oxygen while operating the columns at the lowest effective pressure and at the most efficient reflux ratios.

As mentioned previously, the vapor reflux for the low pressure column is provided by reboiling the oxygen-rich bottoms by heat transfer with feed air. Liquid reflux for the low pressure column may be provided by the condensed top vapor of the medium pressure column.

The medium pressure column separates by rectification the feed air into a nitrogen-rich top fraction and an oxygen-enriched bottom fraction. The column generally is driven by expansion of the liquid bottoms which are introduced to a top condenser. The condenser serves to condense the nitrogen-rich top fraction which is then used as liquid reflux for the medium pressure column and, as indicated above, for the low pressure column as well. The vaporizing medium pressure column bottoms may be then introduced from the top condenser to the low pressure column as an oxygen-enriched vapor feed.

The air feed to the plant is pressurized and cleaned of condensible contaminants such as carbon dioxide and water. The cleaning may be done by means of reversing heat exchangers, molecular sieve adsorbents, or any other suitable means known to the art. The pressurized feed air may then be divided into two portions. One portion may be work expanded to develop plant refrigeration requirements such as water losses associated with the cleaning of the feed air and heat leak from the ambient air to the process equipment. The feed air is then introduced to the medium pressure column as has been described. The other portion, at the higher pressure, is introduced to the low pressure column main condenser. Minor portions of the feed may be used to superheat return streams.

The product of the process of this invention is low purity oxygen. The product is taken from the bottom portion of the low pressure column. Generally it is heated against the incoming feed and recovered at about ambient temperature.

A preferred embodiment of the process of this invention will by described in detail with reference to FIG. 1.

A stream of air 15 which has been pressurized to about 67 psia and is at about ambient temperature is introduced into a reversing heat exchanger 10 where the exit stream 16 is cooled to close to saturation temperature. The reversing heat exchanger 10 cools the air against return streams and serves to clean the air of condensibles. The cleaned and cooled air stream 16 is passed through a suitable adsorbent bed 11, such as silica gel, to further clean the air stream from hydrocarbons and entrained solids. The further cleaned air stream 17 is divided into two portions. One portion, stream 19, is employed for purposes of reversing heat exchanger temperature control and for the generation of plant refrigeration. Stream 19 is dividend into two streams, stream 65 and stream 21. Stream 65 is partially rewarmed in heat exchanger 10 for cold-end temperature control and is removed at intermediate temperature as stream 23. Stream 21 is partially warmed in heat exchanger 14 to a superheated condition 22 and is passed through control valve 12 as stream 24 and combined with stream 23 to form stream 25. Stream 25 is then work expanded in turbine 13 to develop plant refrigeration. The turbine exhaust stream 26 is cooled in heat exchanger 14 and emerges as feed air stream 77 which is fed to the bottom of the medium pressure column 40 at a pressure below that of the air stream to the main condenser. The feed air rises through the column to effect the rectification.

As mentioned, FIG. 1 describes one preferred embodiment of the process of this invention. However, there are many acceptable alternate arrangements. For example, the use of heat exchanger 14 is optional. It would be acceptable to divert some air directly from the cold end of heat exchanger 10 as stream 21 and mix this stream with unbalance stream 23 prior to turbine expansion. Such an arrangement would then directly feed the turbine exhaust stream 26 to the remaining portions of the system. Also, heat exchanger 10, although shown as a reversing heat exchanger unit, could be a combination of warm end prepurification and a primary heat exchanger for cooldown purposes. As is well-known in the air separation art, it is possible to process the pressurized and essentially ambient temperature feed air stream in suitable adsorbent beds such as molecular sieve beds to remove the carbon dioxide and water contaminants and thereby supply a substantially clean feed air stream. For such an arrangement, the air desuperheaters would not be of the pass-reversing type and would simply cool the feed air versus returning streams in a steady operating unit. With such primary air desuperheater, the unbalance stream 23 is not necessary and instead such a stream could be removed direcly from an intermediate temperature level of the heat exchange. The particular choice between reversing heat exchanger or primary heat exchanger options will be dependent on equipment design and cost options which are well-known to persons skilled in the air separation art.

Returning now to FIG. 1, the remaining portion of air stream 17, now stream 18, is supplied in major part to the low pressure column main condenser 45 to reboil the bottom. A small portion 19 of stream 18 passes to heat exchanger 43 to heat the return nitrogen stream 52. The major portion 20 of stream 18 is passed as stream 23 to the main condenser 45, while another small portion 21 passes to heat exchanger 46 to heat the return oxygen product stream 49. The two small air streams 19 and 21 which are used to warm the returning streams, together generally amount to no more than about 2 to 3 percent of the incoming gaseous feed air stream 15.

The feed air at the plant head pressure is condensed in main condenser 45 to reboil the column bottoms. The condensed air stream 24 from the main condenser 45 combines with stream 22 which is the air exit stream from heat exchanger 46 to form stream 25. Stream 25 is divided into two portions; one portion is fed to the medium pressure column and the other to the low pressure column in accord with the teachings of the process of this invention.

One portion of stream 25 passes through expansion valve 26 and proceeds as stream 27 to the medium pressure column 40 as additional feed. Another portion 29 of the condensed air stream is combined with stream 28, an air exit stream from heat exchanger 43, to form stream 30 which is introduced to heat exchanger 43 to warm the return nitrogen stream 52. The air stream then exits heat exchanger 30 as stream 31 which is expanded in valve 32 and introduced 33 to low pressure column 44 as feed.

As indicated previously, the air in the medium pressure column is separated into a nitrogen-rich top vapor fraction and an oxygen-enriched bottom liquid fraction. The oxygen-enriched liquid stream 55 is removed from the bottom of the medium pressure column and expanded through valve 47 to a low pressure oxygen-enriched liquid stream 56, commonly referred to as kettle liquid. This kettle liquid is introduced to heat exchanger vessel 41 where it is vaporized against a nitrogen-rich top vapor fraction stream 59 which is introduced to condenser 42. The resulting condensed nitrogen-rich fraction 60 is divided into two streams. One stream 61 is returned to the low pressure column as liquid reflux. The other stream 62 is subcooled in heat exchanger 43 and passed 63 through expansion valve 48 as low pressure liquid reflux 64 and introduced to low pressure column 44. The vaporizing oxygen-enriched kettle liquid which is now kettle vapor stream 57 is introduced as an intermediate feed to the low pressure column 44. Additionally, to prevent the buildup of hydrocarbons in the oxygen-enriched kettle liquid pool in heat exchanger vessel 41, a small slip stream of kettle liquid 58 is removed from the heat exchanger vessel and introduced to the low pressure column.

The final separation occurs in the low pressure column wherein all the feeds are separated into a nitrogen-rich top fraction and an oxygen-rich bottom fraction. The oxygen-rich bottom fraction is removed as stream 49, warmed in heat exchanger 46, and passed as stream 50 to heat exchanger 10 from which it emerges at substantially ambient temperature and recovered as product oxygen stream 51. The nitrogen-rich top fraction is removed as stream 52, warmed in heat exchanger 43, and passed as stream 53 to heat exchanger 10 where it is warmed to substantially ambient temperature and either recovered or released as stream 54.

In Table I there are listed typical preferred process conditions for the process of this invention. The numerals in Table I correspond to those of FIG. 1. The term, mcfh, refers to thousand cubic feet per hour at standard conditions of 70° F. and 14.7 psia.

TABLE I

| Stream Description | Stream No. | Value |
|---|---|---|
| Product Oxygen | 51 | |
| Flow (mcfh) | — | 1044 |
| Purity (% $O_2$) | — | 96 |
| Pressure (psia) | — | 18 |
| Temperature (K) | | 293 |
| Feed Air to Plant | 15 | |
| Flow (mcfh) | — | 4879 |
| Pressure (psia) | — | 67 |
| Temperature (K) | | 296 |
| Feed Air to Main Condenser | 23 | |
| Flow (mcfh) | — | 2709 |
| Pressure (psia) | — | 65 |
| Temperature (K) | — | 98.5 |
| Feed Air to Medium Pressure Column | 77 | |
| Flow (mcfh) | — | 2000 |
| Pressure (psia) | — | 43 |
| Temperature (K) | — | 102 |
| Condensed Air to Low Pressure Column | 31 | |
| Flow (mcfh) | — | 1150 |
| Pressure (psia) | — | 64 |
| Temperature (K) | — | 86 |
| Condensed Air to Medium Pressure Column | 29 | |
| Flow (mcfh) | — | 1729 |
| Pressure (psia) | — | 64 |
| Temperature (K) | — | 94.5 |
| Feed Air to Superheaters | 19 & 21 | |
| Flow (mcfh) | | 170 |
| Pressure (psia) | | 65 |
| Temperature (K) | | 98.5 |

Although the process of this invention has been described in detail with regard to certain preferred embodiments, those skilled in the art will readily recognize that there are many other embodiments of the process of this invention which are within the scope of the invention as described and claimed.

What is claimed is:

1. In a process for the production of oxygen by the fractionation of air, wherein feed air at greater than atmospheric pressure and substantially free of water and carbon dioxide is introduced (a) into a medium pressure column where it is separated by rectification into a nitrogen-rich fraction and an oxygen-enriched fraction, and (b) into a low pressure column where it is separated by rectification into a nitrogen-rich fraction and a product oxygen fraction; and wherein the low pressure column bottoms are reboiled in a main condenser to produce vapor reflux by indirect heat transfer with a higher pressure condensing feed air stream, the improvement comprising:

(1) introducing from about 50 to 75 percent of the gaseous feed air into the main condenser as said condensing feed air stream;

(2) introducing from about 25 to 50 percent of the gaseous feed air into the medium pressure column at a pressure lower than the pressure of said condensing feed air stream;

(3) expanding the condensed feed air stream to a lower pressure;

(4) introducing from about 50 to 75 percent of the condensed feed air stream into the medium pressure column as additional feed; and (5) introducing from about 25 to 50 percent of the condensed feed air stream into the low pressure column as feed; thereby enabling both the low pressure column and the medium pressure column to be operated at down to the lowest effective pressure and up to the most efficient reflux ratio.

2. The process of claim 1 wherein the oxygen produced has a purity of from about 90 to 99 percent.

3. The process of claim 1 wherein said higher pressure condensing feed air stream is at a pressure of from about 50 to 80 psia.

4. The process of claim 1 wherein air is introduced to the medium pressure column at a pressure of from about 30 to 60 psia.

5. The process of claim 1 wherein said low pressure column is operating at a pressure of from about 15 to 25 psia.

6. The process of claim 1 wherein from about 50 to 60 percent of the gaseous feed air is introduced into the main condenser and from about 35 to 50 percent of the gaseous feed air is introduced into the medium pressure column.

7. The process of claim 1 wherein from about 60 to 70 percent of the condensed feed air stream is introduced into the medium pressure column and from about 30 to 40 percent of the condensed feed air stream is introduced into the low pressure column.

8. The process of claim 1 wherein said nitrogen-rich fraction from the medium pressure column is condensed and introduced into both the medium pressure column and the low pressure column as liquid reflux.

9. The process of claim 1 wherein said oxygen-enriched fraction from the medium pressure column is vaporized and introduced into the low pressure column as intermediate feed.

10. The process of claim 1 wherein in step (2) the air is introduced to the bottom of the medium pressure column.

* * * * *